US011815228B2

(12) United States Patent
Kwon

(10) Patent No.: US 11,815,228 B2
(45) Date of Patent: Nov. 14, 2023

(54) SYSTEM AND METHOD FOR FILLING TANK

(71) Applicants: Hyundai Motor Company, Seoul (KR); Kia Corporation, Seoul (KR)

(72) Inventor: Woo Jung Kwon, Gyeonggi-do (KR)

(73) Assignees: Hyundai Motor Company, Seoul (KR); Kia Corporation, Seoul (KR)

( * ) Notice: Subject to any disclaimer, the term of this patent is extended or adjusted under 35 U.S.C. 154(b) by 66 days.

(21) Appl. No.: 17/315,950

(22) Filed: May 10, 2021

(65) Prior Publication Data

US 2022/0186878 A1 Jun. 16, 2022

(30) Foreign Application Priority Data

Dec. 16, 2020 (KR) ..... 10-2020-0176780

(51) Int. Cl.
*F17C 5/00* (2006.01)
*F17C 13/04* (2006.01)

(52) U.S. Cl.
CPC ..... *F17C 5/007* (2013.01); *F17C 13/04* (2013.01); *F17C 2205/0134* (2013.01); *F17C 2205/0326* (2013.01); *F17C 2205/0338* (2013.01); *F17C 2221/012* (2013.01); *F17C 2250/043* (2013.01); *F17C 2250/0439* (2013.01); *F17C 2250/075* (2013.01); *F17C 2260/026* (2013.01); *F17C 2265/065* (2013.01); *F17C 2270/0139* (2013.01)

(58) Field of Classification Search
CPC .. F17C 5/007; F17C 13/04; F17C 2205/0134; F17C 2205/0326; F17C 2205/0338; F17C 2221/012; F17C 2250/043; F17C 2250/0439; F17C 2250/075; F17C 2260/026; F17C 2265/065; F17C 2270/0139
USPC ..... 141/197
See application file for complete search history.

(56) References Cited

U.S. PATENT DOCUMENTS 7,325,561 B2 * 2/2008 Mathison ..... B60K 15/00 141/197
8,534,327 B2 * 9/2013 Inagi ..... F17C 5/06 141/83

FOREIGN PATENT DOCUMENTS

JP 2005-226716 A 8/2005

* cited by examiner

*Primary Examiner* — Timothy P. Kelly
*Assistant Examiner* — Christopher M Afful
(74) *Attorney, Agent, or Firm* — Fox Rothschild LLP

(57) ABSTRACT

A system and a method for filling a tank are provided. The tank filling system includes tanks that are filled with predetermined fluid and a manifold that is coupled to each of the plurality of tanks in a communication manner. A first flow passage is connected to a first inlet of the manifold to supply the fluid to be filled into the plurality of tanks to the manifold and a second flow passage is connected to a second inlet of the manifold spaced apart from the first inlet of the manifold by a predetermined distance to supply the fluid to be filled into the plurality of tanks to the manifold. A controller opens and closes the first flow passage and the second flow passage.

17 Claims, 10 Drawing Sheets

SYSTEM AND METHOD FOR FILLING TANK

CROSS-REFERENCE TO RELATED APPLICATION

This application claims the benefit of priority to Korean Patent Application No. 10-2020-0176780, filed in the Korean Intellectual Property Office on Dec. 16, 2020, the entire contents of which are incorporated herein by reference.

TECHNICAL FIELD

The present disclosure relates to a system and a method for filling a tank, and more particularly, to a system and method for filling a tank that balance a filling amount deviation between tanks.

BACKGROUND

A typical fuel cell vehicle generates electric energy through reverse electrolysis caused by a reaction between hydrogen and air. In this connection, the hydrogen flows along a hydrogen filling line of a hydrogen storage system and is stored in a hydrogen storage tank. Recently, a form in which a plurality of small-diameter hydrogen storage tanks obtained by miniaturizing such hydrogen storage tank are connected to one manifold has been developed.

In such small-diameter tank system, the hydrogen is injected into one inlet through the single manifold to which each small-diameter tank is connected. In particular, since a differential pressure generated in a flow passage inside the manifold, a filling amount deviation and a temperature deviation between the tanks increase in an ascending order of a distance to the inlet. In this connection, when a pressure of the closest tank reaches a target filling pressure, it is impossible to physically supply additional hydrogen, and a filling process is terminated. Thereafter, as time passes, when filling amounts of the tanks are in equilibrium, a pressure of the entire system becomes lower than the target filling pressure.

SUMMARY

The present disclosure provides a system and a method for filling a tank that may balance a filling amount deviation between tanks. The technical problems to be solved by the present inventive concept are not limited to the aforementioned problems, and any other technical problems not mentioned herein will be clearly understood from the following description by those skilled in the art to which the present disclosure pertains.

According to an aspect of the present disclosure, a system for filling a tank may include a plurality of tanks that are filled with predetermined fluid, a manifold coupled to each of the plurality of tanks in a communication manner, a first flow passage connected to a first inlet of the manifold to supply the fluid to be filled into the plurality of tanks to the manifold, a second flow passage connected to a second inlet of the manifold spaced apart from the first inlet of the manifold by a predetermined distance to supply the fluid to be filled into the plurality of tanks to the manifold, and a controller configured to open and close the first flow passage and the second flow passage.

In one implementation, the controller may be configured to adjust the opening and the closing of the first flow passage and the second flow passage based on filling amounts of at least some of the plurality of tanks. The controller may be configured to obtain filling amounts of at least some of the plurality of tanks, and close a flow passage connected to one of the first inlet and the second inlet close to a maximum filling tank and open a flow passage connected to the other of the first inlet and the second inlet far from the maximum filling tank when a tank having a maximum filling amount among the tanks whose filling amounts are obtained is referred to as the maximum filling tank.

In addition, the controller may be configured to obtain filling amounts of at least some of the plurality of tanks, and open a flow passage connected to one of the first inlet and the second inlet close to a minimum filling tank and close a flow passage connected to the other of the first inlet and the second inlet far from the minimum filling tank when a tank having a minimum filling amount among the tanks whose filling amounts are obtained is referred to as the minimum filling tank. The controller may be configured to open the first flow passage and close the second flow passage to initiate supply of the fluid through the first inlet, obtain a filling amount of a first inlet-closest-tank closest to the first inlet among the plurality of tanks, and close the first flow passage and open the second flow passage to initiate supply of the fluid through the second inlet when the filling amount of the first inlet-closest-tank reaches a reference filling amount.

Further, the controller may be configured to determine the reference filling amount based on a difference between the filling amount of the first inlet-closest-tank when the supply of the fluid through the first inlet is initiated, and a target filling amount of the first inlet-closest-tank. The plurality of tanks may be arranged in a predetermined reference direction, the first inlet may be disposed proximate to a first tank disposed first along the reference direction among the plurality of tanks, and the second inlet may be disposed proximate to a second tank disposed last along the reference direction among the plurality of tanks.

The system may further include a valve for determining the opening and the closing of the first flow passage and the second flow passage, and the controller may be configured to operation the valve. The second flow passage may be connected to the first flow passage, and the valve may be disposed at a connection point between the first flow passage and the second flow passage to transfer the fluid supplied to the valve to at least one of the first flow passage or the second flow passage.

In one implementation, the controller may be configured to calculate the filling amount of the first inlet-closest-tank based on a pressure inside the first inlet-closest-tank. The controller may be configured to determine whether to convert opened/closed states of the first flow passage and the second flow passage based on comparison between information on a first filling amount that is a filling amount of a first tank disposed first along a predetermined reference direction among the plurality of tanks and information on a second filling amount that is a filling amount of a second tank disposed last along the reference direction among the plurality of tanks, the first inlet may be disposed proximate to the first tank, and the second inlet may be disposed proximate to the second tank.

The controller may be configured to open the first flow passage in the closed state and close the second flow passage in the opened state when the second filling amount becomes equal to or greater than the first filling amount by supply of the fluid through the second flow passage. The controller may be configured to calculate the first filling amount based on a temperature of the first tank, and calculate the second filling amount based on a temperature of the second tank.

According to another aspect of the present disclosure, a system for filling a tank may include a tank formed in a tubular shape to be filled with predetermined fluid, a first flow passage connected to a first entrance of the tank to supply the fluid into the tank, a second flow passage connected to a second entrance of the tank spaced apart from the first entrance of the tank by a predetermined distance to supply the fluid into the tank, and a controller configured to open and close the first flow passage and the second flow passage based on filling amounts of at least some of a plurality of regions when dividing the tank into the plurality of regions.

According to another aspect of the present disclosure, a method for filling a tank may include, when a condition for converting a flow passage for supplying the hydrogen to a manifold from a first flow passage proximate to a first tank to a second flow passage connected to the manifold to be spaced apart from the first tank based on a filling amount of the first tank disposed first along a reference direction among a plurality of tanks coupled to the manifold to be arranged in the predetermined reference direction is a conversion condition, injecting the hydrogen into the plurality of tanks through the first flow passage, converting the flow passage for supplying the hydrogen to the manifold from the first flow passage to the second flow passage in response to determining that the conversion condition has been achieved, and closing all flow passages in response to determining that at least one of the plurality of tanks is filled by a target filling amount.

The method may further include, when a condition of re-converting the flow passage for supplying the hydrogen to the manifold from the second flow passage to the first flow passage is a re-conversion condition, re-converting the flow passage for supplying the hydrogen to the manifold from the second flow passage to the first flow passage in response to determining that the re-conversion condition has been achieved before the closing of all the flow passages. The second flow passage may be a flow passage proximate to a second tank disposed last along the reference direction among the plurality of tanks.

BRIEF DESCRIPTION OF THE DRAWINGS

The above and other objects, features and advantages of the present disclosure will be more apparent from the following detailed description taken in conjunction with the accompanying drawings.

DETAILED DESCRIPTION

Figure 1:
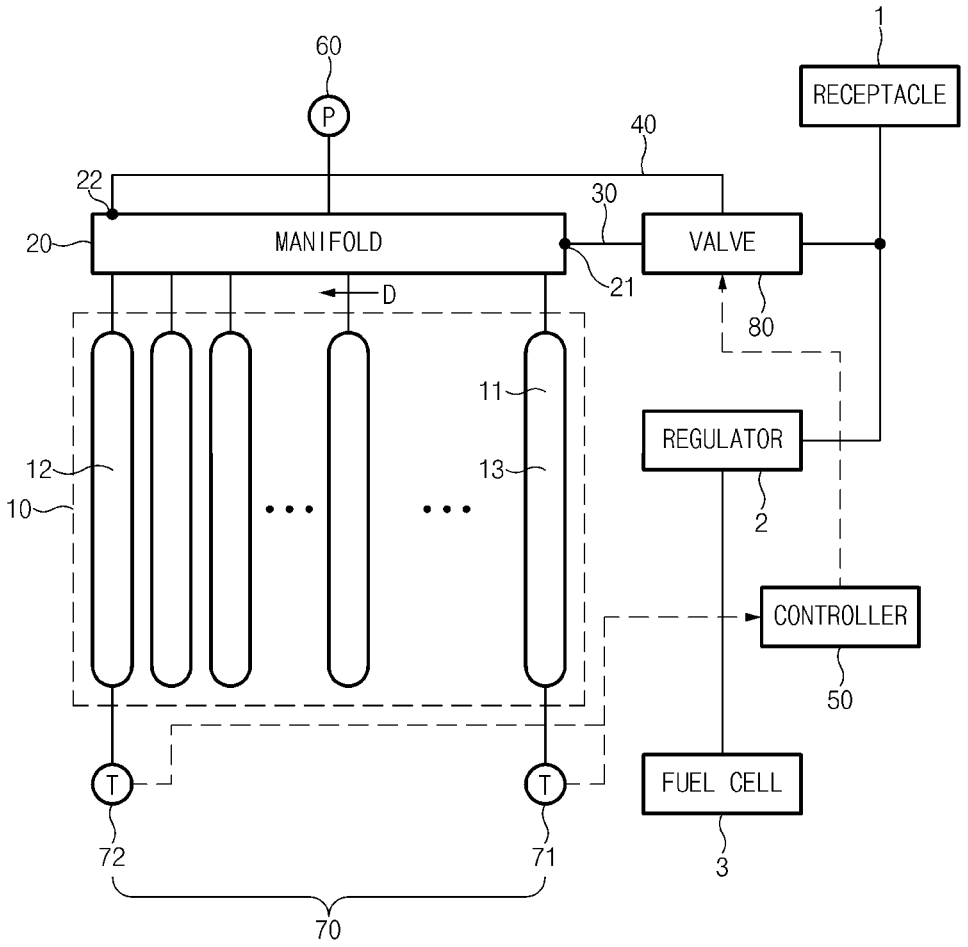
FIG. 1 is a view illustrating a tank filling system according to a first exemplary embodiment of the present disclosure.

It is understood that the term "vehicle" or "vehicular" or other similar term as used herein is inclusive of motor vehicles in general such as passenger automobiles including sports utility vehicles (SUV), buses, trucks, various commercial vehicles, watercraft including a variety of boats and ships, aircraft, and the like, and includes hybrid vehicles, electric vehicles, combustion, plug-in hybrid electric vehicles, hydrogen-powered vehicles and other alternative fuel vehicles (e.g. fuels derived from resources other than petroleum).

Although exemplary embodiment is described as using a plurality of units to perform the exemplary process, it is understood that the exemplary processes may also be performed by one or plurality of modules. Additionally, it is understood that the term controller/control unit refers to a hardware device that includes a memory and a processor and is specifically programmed to execute the processes described herein. The memory is configured to store the modules and the processor is specifically configured to execute said modules to perform one or more processes which are described further below.

The terminology used herein is for the purpose of describing particular embodiments only and is not intended to be limiting of the disclosure. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof. As used herein, the term "and/or" includes any and all combinations of one or more of the associated listed items.

Unless specifically stated or obvious from context, as used herein, the term "about" is understood as within a range of normal tolerance in the art, for example within 2 standard deviations of the mean. "About" can be understood as within 10%, 9%, 8%, 7%, 6%, 5%, 4%, 3%, 2%, 1%, 0.5%, 0.1%, 0.05%, or 0.01% of the stated value. Unless otherwise clear from the context, all numerical values provided herein are modified by the term "about."

Hereinafter, some exemplary embodiments of the present disclosure will be described in detail with reference to the exemplary drawings. In adding the reference numerals to the components of each drawing, it should be noted that the identical or equivalent component is designated by the identical numeral even when they are displayed on other drawings. Further, in describing the embodiment of the present disclosure, a detailed description of the related known configuration or function will be omitted when it is determined that it interferes with the understanding of the exemplary embodiment of the present disclosure.

First Exemplary Embodiment

A tank filling system according to a first exemplary embodiment of the present disclosure relates to a tank filling system for a fluid storage tank constructed to store fluid to be supplied to a fuel cell stack of a fuel cell vehicle therein. The tank filling system according to a first exemplary embodiment of the present disclosure may include a plurality of tanks 10, a manifold 20, a first flow passage 30, a second flow passage 40, and a controller 50. FIG. 1 is a view illustrating a tank filling system according to the first embodiment of the present disclosure. In this connection, a receptacle 1, a regulator 2, and a fuel cell 3 are components commonly used in the fuel cell vehicle, so that detailed descriptions thereof are omitted.

Each of the plurality of tanks 10 may be constructed to be filled with predetermined fluid. The predetermined fluid may be hydrogen, but is not limited thereto, and is not limited as long as being able to be used as fuel. In this connection, the plurality of tanks 10 may be arranged in a predetermined reference direction D.

The manifold 20 may be coupled to each of the plurality of tanks 10 in a communication manner. The manifold 20 may be understood as a type of pipe along which the fluid may be introduced. The manifold 20 may include a first inlet 21 and a second inlet 22. For example, the first inlet 21 may be disposed proximate to a first tank 11. The first tank 11 may be a tank disposed first along the reference direction D among the plurality of tanks 10. In addition, as an example, the second inlet 22 may be disposed proximate to a second tank 12. The second tank 12 may be a tank disposed last along the reference direction D among the plurality of tanks 10. However, positions of the first inlet 21 and the second inlet 22 are not limited to those described above, and the positions thereof may be adjusted based on a need for solving a filling amount deviation between the tanks, which is the purpose of the present disclosure.

The first flow passage 30 may be connected to the first inlet 21 of the manifold 20. The first flow passage 30 may be constructed to supply the fluid to be filled in the plurality of tanks 10 to the manifold 20. The second flow passage 40 may be connected to the second inlet 22 of the manifold 20. The second inlet 22 may be an inlet spaced apart from the first inlet 21 of the manifold 20 by a predetermined distance. The second flow passage 40 may be constructed to supply the fluid to be filled in the plurality of tanks 10 to the manifold 20.

The controller 50 may be configured to adjust opening and closing of the first flow passage 30 and the second flow passage 40. The controller 50 may include a processor and a memory. The processor may include a microprocessor such as a field programmable gate array (FPGA), an application specific integrated circuit (ASIC), a central processing unit (CPU), and the like. The memory may be configured to store control instructions that are the basis for generating, by the processor, a command and the like for determining whether to open or close the first flow passage 30 and the second flow passage 40. The memory may be a data storage such as a hard disk drive (HDD), a solid state drive (SSD), a volatile medium, a nonvolatile medium, and the like.

Figure 2:
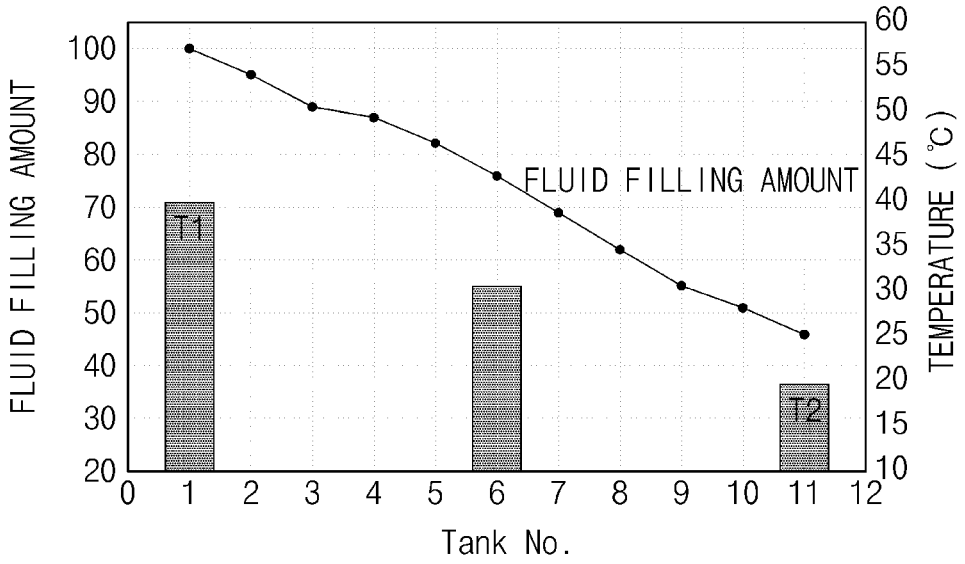
FIG. 2 is a graph illustrating a distribution of fluid filling amounts and a temperature when fluid is filled in a plurality of tanks through a first flow passage according to an exemplary embodiment of the present disclosure.

For example, a tank filling system including only the first flow passage 30 may be considered. FIG. 2 is a graph illustrating a distribution of amounts of the fluid filled in the plurality of tanks 10 (hereinafter, 'fluid filling amounts') and a temperature when the fluid is filled in the plurality of tanks 10 through the first flow passage 30. The graph of the distribution of the fluid filling amounts is illustrated as a broken line graph, and the temperature graph is illustrated as a bar graph. In this connection, an X axis indicates a tank number, a left Y axis indicates the fluid filling amount, and a right Y axis indicates a tank temperature. The tank numbers refer to numbers assigned to the plurality of tanks 10 in an order close to the first flow passage 30. For reference, this content may be applied as it is to FIGS. 3 to 5 to be described later. In addition, in the graph, T1 is a temperature of a first tank and T2 is a temperature of a second tank.

Referring to FIG. 2, the closer the tank is to the first flow passage 30, the higher the filling amount and the temperature are, and the farther the tank is from the first flow passage 30, the lower the filling amount and the temperature are. In other words, when the fluid is filled in the tanks only through the first flow passage 30, a deviation may occur between the filling amounts of the tanks. This indicates that some tanks may not be sufficiently filled with the fluid.

Figure 3:
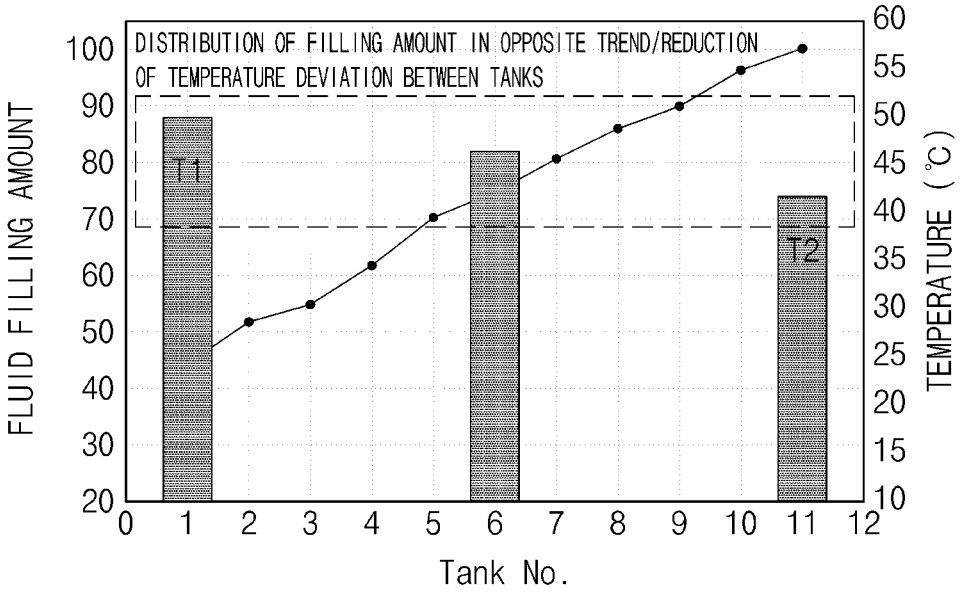
FIG. 3 is a graph illustrating a distribution of fluid filling amounts and a temperature after converting a flow passage for filling fluid into a plurality of tanks from a first flow passage to a second flow passage according to an exemplary embodiment of the present disclosure.

According to the present disclosure, since the first flow passage 30 and the second flow passage 40 are connected to the manifold 20, the filling amount deviation between the plurality of tanks 10 may be balanced through conversion of the flow passage. This will be described in detail with reference to FIGS. 3 and 4. FIG. 3 is a graph illustrating the distribution of the fluid filling amounts and the temperature after converting the flow passage for filling the fluid into the plurality of tanks 10 from the first flow passage to the second flow passage 40. In other words, FIG. 3 may provide a graph at one time point after the fluid is introduced into the plurality of tanks 10 through the second flow passage 40 as the flow passage along which the fluid is introduced is converted from the first flow passage 30 to the second flow passage 40 after the fluid flows into the plurality of tanks 10 through the first flow passage 30 until a predetermined time point.

Referring to FIG. 3, the farther the tank is from the first flow passage 30, the higher the fluid filling amount is, and the closer the tank is to the first flow passage 30, the lower the fluid filling amount is. In this connection, a tank far from the first flow passage 30 may be a tank close or proximate to the second flow passage 40, and a tank close or proximate to the first flow passage 30 may be a tank far from the second flow passage 40. In addition, FIG. 3 shows that a temperature gap is reduced compared to FIG. 2.

Figure 4:
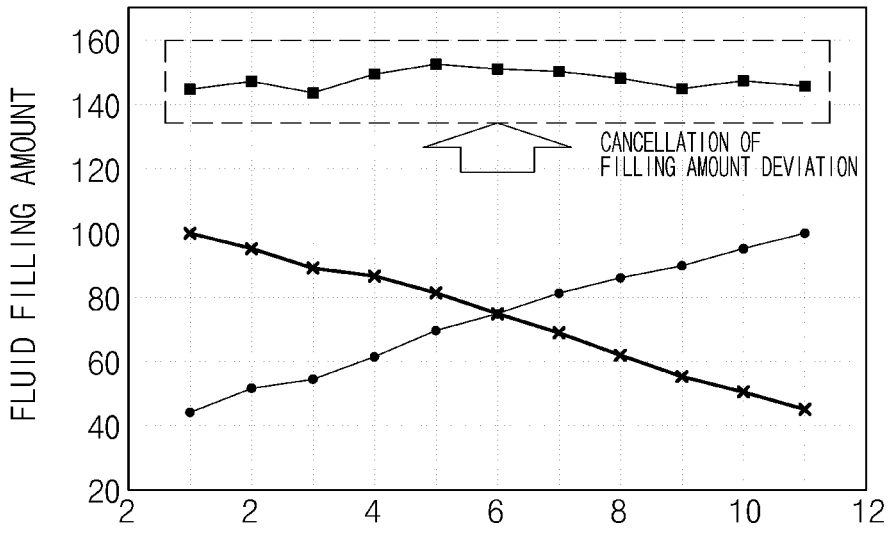
FIG. 4 illustrates a graph combining fluid filling amount graphs in FIGS. 2 and 3 with each other according to an exemplary embodiment of the present disclosure.

FIG. 4 illustrates a graph combining fluid filling amount graphs in FIGS. 2 and 3 with each other. In FIG. 4, a broken line displayed at a top represents a sum of the fluid filling amount for each tank. As shown in FIG. 4, according to the present disclosure, the deviation between the fluid filling amounts of the tanks may be reduced. In other words, according to the present disclosure, all tanks may be evenly and sufficiently filled.

Figure 5:
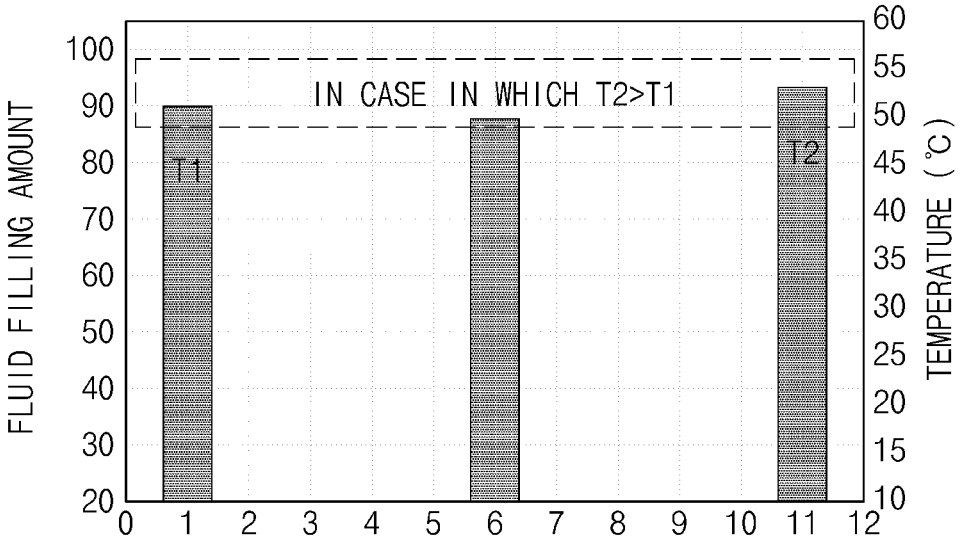
FIG. 5 is a graph illustrating a case in which a temperature of a tank far from a first flow passage is higher than a temperature of a tank close to the first flow passage as fluid continues to be introduced through a second flow passage according to an exemplary embodiment of the present disclosure.

FIG. 5 is a graph illustrating a case in which a temperature of the tank far from the first flow passage 30 is greater than a temperature of the tank close to the first flow passage 30 as the fluid continues to be introduced through the second flow passage 40. The temperature of the tank is proportional to the fluid filling amount. In other words, it may be seen that FIG. 5 illustrates the temperature of the tank far from the first flow passage 30 and the temperature of the tank close or proximate to the first flow passage 30 at a time point at which re-conversion of the flow passage from the second flow passage 40 to the first flow passage 30 is required.

According to the present disclosure, at the time point as shown in FIG. 5, the fluid filling amounts of the plurality of tanks 10 may be balanced by changing the flow passage along which the fluid is introduced from the second flow passage 40 to the first flow passage 30 again.

The controller 50 may be configured to adjust the opening and the closing of the first flow passage 30 and the second flow passage 40 based on filling amounts of at least some of the plurality of tanks 10. More specifically, the controller 50 may be configured to obtain the filling amounts of the at least some of the plurality of tanks 10, and close a flow passage connected to one of the first inlet 21 and the second inlet 22 close to a maximum filling tank and open a flow passage connected to the other of the first inlet 21 and the second inlet 22 far from the maximum filling tank. The maximum filling tank may indicate a tank having a maximum filling amount among the tanks whose filling amounts are obtained.

Alternatively, the controller 50 may be configured to obtain the filling amounts of the at least some of the plurality of tanks 10, and open a flow passage connected to one of the first inlet 21 and the second inlet 22 close to a minimum filling tank and close a flow passage connected to the other of the first inlet 21 and the second inlet 22 far from the minimum filling tank. The minimum filling tank may indicate a tank having a minimum filling amount among the tanks whose filling amounts are obtained.

Hereinafter, the control, by the controller 50, of the opening and the closing of the first flow passage 30 and the second flow passage 40 will be described in more detail with the passage of time. The controller 50 may be configured to open the first flow passage 30 and close the second flow passage 40 to initiate supply of the fluid through the first inlet 21. Thereafter, the controller 50 may be configured to obtain a filling amount of a first inlet-closest-tank 13 closest to the first inlet 21 among the plurality of tanks 10. The controller 50 may be configured to calculate the filling amount of the first inlet-closest-tank 13 based on a pressure inside the first inlet-closest-tank 13. The pressure inside the first inlet-closest-tank may be obtained by a pressure sensor 60 to be described later. The first inlet-closest-tank 13 may be the first tank 11.

Thereafter, when the filling amount of the first inlet-closest-tank 13 reaches a reference filling amount, the controller 50 may be configured to close the first flow passage 30 and open the second flow passage 40 to initiate supply of the fluid through the second inlet 22. In other words, the flow passage along which the fluid is supplied may be converted from the first flow passage 30 to the second flow passage 40. The controller 50 may be configured to determine the reference filling amount based on a difference between the filling amount of the first inlet-closest-tank 13 when the supply of the fluid through the first inlet 21 is initiated, and a target filling amount of the first inlet-closest-tank 13. For example, the reference filling amount may be an intermediate value between the filling amount of the first inlet-closest-tank 13 when the supply of the fluid through the first inlet 21 is initiated, and the target filling amount.

Hereinafter, another method for determining, by the controller 50, whether to convert opened/closed states of the first flow passage 30 and the second flow passage 40 will be described in detail. The controller 50 may be configured to determine whether to convert the opened/closed states of the first flow passage 30 and the second flow passage 40 based on a comparison between information on a first filling amount and information on a second filling amount. The first filling amount may be a filling amount of the first tank 11. The second filling amount may be the filling amount of the second tank 12.

Hereinafter, as a method for determining, by the controller 50, a time point to convert the flow passage, a method of using the pressure sensor will be described in detail. The pressure sensor 60 may be configured to measure the pressure inside the first inlet-closest-tank 13. In response to determining that the pressure inside the first inlet-closest-tank 13 obtained by the pressure sensor 60 is less than a predetermined reference pressure, the controller 50 may be configured to determine to open the first flow passage 30 and close the second flow passage 40. In addition, in response to determining that the pressure inside the first inlet-closest-tank 13 obtained by the pressure sensor 60 is equal to or greater than the predetermined reference pressure, the controller 50 may be configured to determine to close the first flow passage 30 and open the second flow passage 40.

Since a pressure and a filling amount of gas are proportional to each other, the filling amount may be calculated by measuring the pressure. The reference pressure may be a pressure when the fluid is filled by the reference filling amount. As an example, the reference pressure may be an intermediate value between a pressure inside the first inlet-closest-tank 13 before the fluid is introduced and a target pressure inside the first inlet-closest-tank 13 to be finally achieved.

Hereinafter, as the method for determining, by the controller 50, the time point to convert the flow passage, a method of using a temperature sensor will be described in detail. The controller 50 may be configured to determine whether to convert the opened/closed states of the first flow passage 30 and the second flow passage 40 based on information on a first temperature and information on a second temperature. The first temperature may be a temperature of the first tank 11 obtained by a first temperature sensor 71 connected to the first tank 11. The second temperature may be a temperature of the second tank 12 obtained by a second temperature sensor 72 connected to the second tank 12.

The controller 50 may be configured to calculate the first filling amount described above based on the first temperature, and calculate the second filling amount based on the second temperature. The conversion at this time may be the re-conversion. An example of the re-conversion is re-opening the first flow passage 30 that was in the closed state from the opened state, and re-closing the second flow passage 40 that was in the opened state from the closed state.

As an example, as shown in FIG. 5, when the second temperature is greater than the first temperature due to the supply of the fluid through the second flow passage 40, the controller 50 may be configured to determine to re-open the first flow passage 30 that was in the closed state from the opened state and re-close the second flow passage 40 that was in the opened state from the closed state. As an example, the determining of the re-conversion time point by comparing temperatures of the tanks using the temperature sensor has been described herein. However, the method for determining the re-conversion time point may not be limited to the comparison of the temperature, and there may be various examples such as the method for comparing the pressures of the tanks using the pressure sensor or the method for directly comparing the filling amounts of the tanks.

The tank filling system according to the first exemplary embodiment of the present disclosure may further include the valve 80. The valve 80 may be configured to determine the opening and the closing of the first flow passage 30 and the second flow passage 40. As an example, the valve 80 may be a three-way valve. The controller 50 may be configured to operate the valve 80. In other words, the controller 50 may be configured to operate the valve 80 to open the first flow passage 30 and close the second flow passage 40, or close the first flow passage 30 and open the second flow passage 40.

The second flow passage 40 may be connected to the first flow passage 30. In other words, it may be understood that the second flow passage 40 is formed by branching from the first flow passage 30. The valve 80 may be disposed at a connection point of the first flow passage 30 and the second flow passage 40. The valve 80 may be constructed to transfer the fluid supplied to the valve 80 to at least one of the first flow passage 30 or the second flow passage 40. As another example, each valve 80 may be disposed on each of the first flow passage 30 and the second flow passage 40 to open and close each of the first flow passage 30 and the second flow passage 40.

Figure 6:
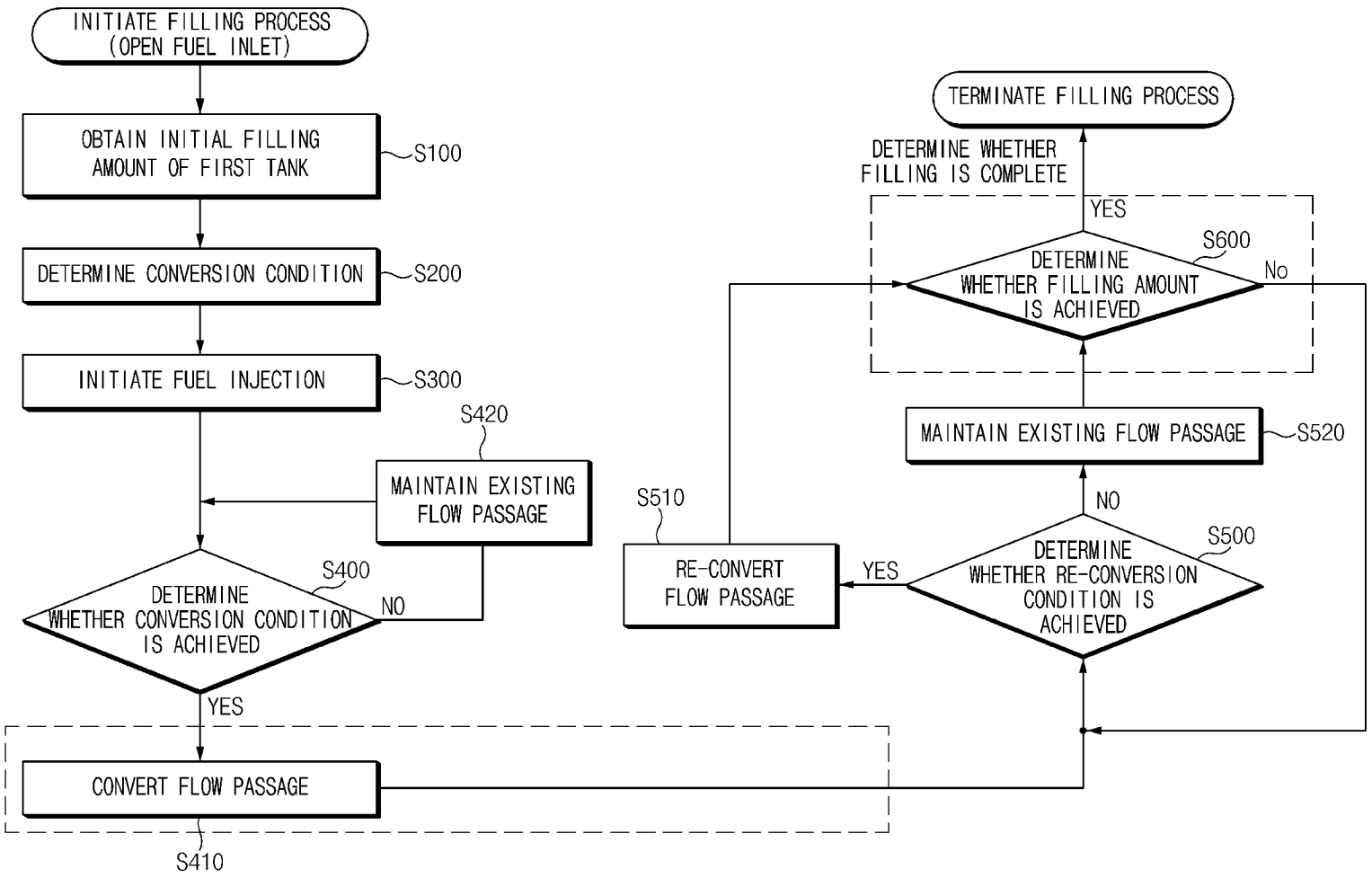
FIG. 6 is a flowchart illustrating a tank filling method according to a first exemplary embodiment of the present disclosure.

Hereinafter, the method for filling the tank will be described in detail with reference to FIG. 6. FIG. 6 is a flowchart illustrating a tank filling method according to a first exemplary embodiment of the present disclosure. The method for filling the tank according to the first embodiment of the present disclosure may be a tank filling method for a hydrogen storage tank constructed to store therein the hydrogen to be supplied to the fuel cell stack of the fuel cell vehicle.

The tank filling method according to the first exemplary embodiment of the present disclosure may be performed in a following order. First, the controller 50 may be configured to obtain an initial filling amount of the first tank 11 (S100). Second, the controller 50 may be configured to determine a conversion condition for converting the flow passage along which the hydrogen is introduced from the first flow passage 30 close or proximate to the first tank 11 to the second flow passage 40 based on the initial filling amount of the first tank 11 (S200). The second flow passage 40 may be close or proximate to the second tank 12. However, this operation may be changed in order with a third operation (S300) to be described later.

Third, the controller 50 may be configured to inject the hydrogen into the plurality of tanks 10 through the first flow passage 30 (S300). Fourth, the controller 50 may be configured to determine whether to convert the flow passage by determining whether the conversion condition is achieved (S400). For example, the conversion condition may be whether the pressure inside the first tank 11 is equal to or greater than the predetermined reference pressure. Specifically, when the conversion condition is achieved, the flow passage may be converted from the first flow passage 30 to the second flow passage 40 (S410). When the conversion condition is not achieved, the hydrogen may be continuously injected through the first flow passage 30 (S420). Hereinafter, a detailed description will be achieved assuming that the conversion condition is achieved and the flow passage is converted from the first flow passage 30 to the second flow passage 40.

Fifth, the controller 50 may be configured to determine whether to re-convert the flow passage by determining whether a re-conversion condition for re-converting the flow passage by closing a flow passage along which the hydrogen is being introduced among the first flow passage 30 and the second flow passage 40 and opening a closed flow passage among the first flow passage 30 and the second flow passage is achieved (S500). For example, the re-conversion condition may be whether the second temperature is equal to or greater than the first temperature. In particular, when the re-conversion condition is achieved, the flow passage may be re-converted from the second flow passage 40 to the first flow passage 30 (S510). When the re-conversion condition is not achieved, the hydrogen may be continuously injected through the second flow passage 40 (S520).

Sixth, determining, by the controller 50, whether the plurality of tanks 10 are filled by the target filling amount may be included (S600). For example, the controller 50 may be configured to determine whether a pressure inside the manifold 20 has reached a target pressure. In response to determining that the plurality of tanks 10 are filled by the target filling amount, the controller 50 may be configured to close all flow passages and stop the injection of the hydrogen. In response to determining that the plurality of tanks 10 are not filled by the target filling amount, it may be possible to return to operation S500 of determining whether to re-convert the flow passage. At this time, the re-conversion condition may be newly set.

According to the tank filling method according to the first exemplary embodiment of the present disclosure, because the filling amounts of the plurality of tanks 10 may be balanced through the conversion and the re-conversion of the flow passage, the deviation between the filling amounts of the plurality of tanks 10 may be balanced.

Second Exemplary Embodiment

Figure 7:
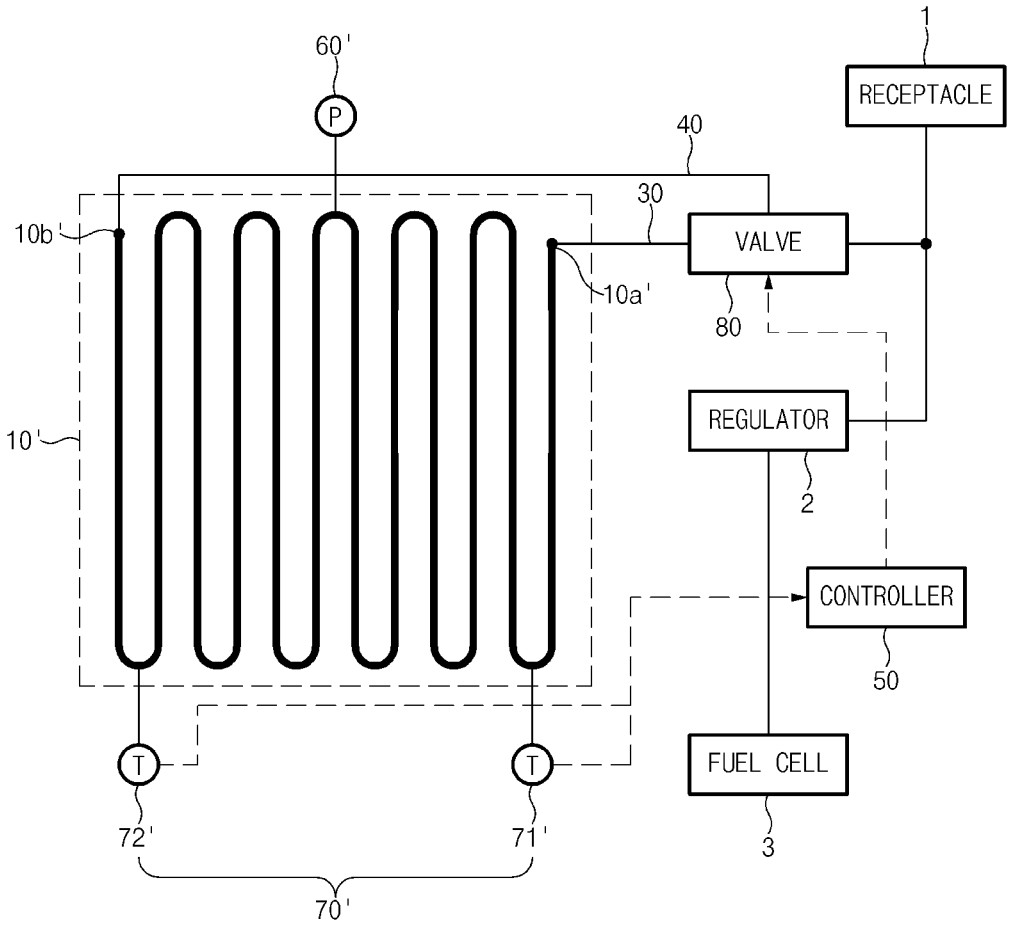
FIG. 7 is a view illustrating a tank filling system according to a second exemplary embodiment of the present disclosure.

Hereinafter, referring to FIG. 7, a tank filling system according to a second exemplary embodiment of the present disclosure will be described in detail. FIG. 7 is a view illustrating a tank filling system according to a second exemplary embodiment of the present disclosure. The tank filling system according to the second exemplary embodiment of the present disclosure differs from the tank filling system of the first exemplary embodiment described above in a shape of a tank 10'. Components that are the same as or equivalent to those in the first exemplary embodiment are assigned with the same or equivalent reference numerals or are omitted, and detailed descriptions thereof are omitted.

As shown in FIG. 7, the tank 10' of the tank filling system according to the second exemplary embodiment of the present disclosure may be formed in a tubular shape to be filled with the predetermined fluid. More specifically, as shown in FIG. 7, the tank 10' of the tank filling system according to the second exemplary embodiment of the present disclosure may be in a form in which a u-shaped tube and an n-shaped tube are connected to each other in a repeated manner.

The first flow passage 30 may be connected to a first entrance 10*a*' of the tank 10' to supply the fluid into the tank 10'. The second flow passage 40 may be connected to a second entrance 10*b*' of the tank 10' to supply the fluid into the tank 10'. The second entrance 10*b*' may be an inlet spaced apart from the first entrance 10*a*' by a predetermined distance. As an example, the first entrance 10*a*' may be a first end of the tank 10' and the second entrance 10*b*' may be a second end of the tank 10'.

When dividing the tank 10' into a plurality of regions, the controller 50 may be configured to adjust the opening and the closing of the first flow passage 30 and the second flow passage 40 based on filling amounts of at least some of the plurality of regions. For example, when a filling amount of a region close to the first flow passage 30 is equal to or greater than a reference filling amount, the controller 50 may be configured to close the first flow passage 30 and open the second flow passage 40.

Third Exemplary Embodiment

Figure 8:
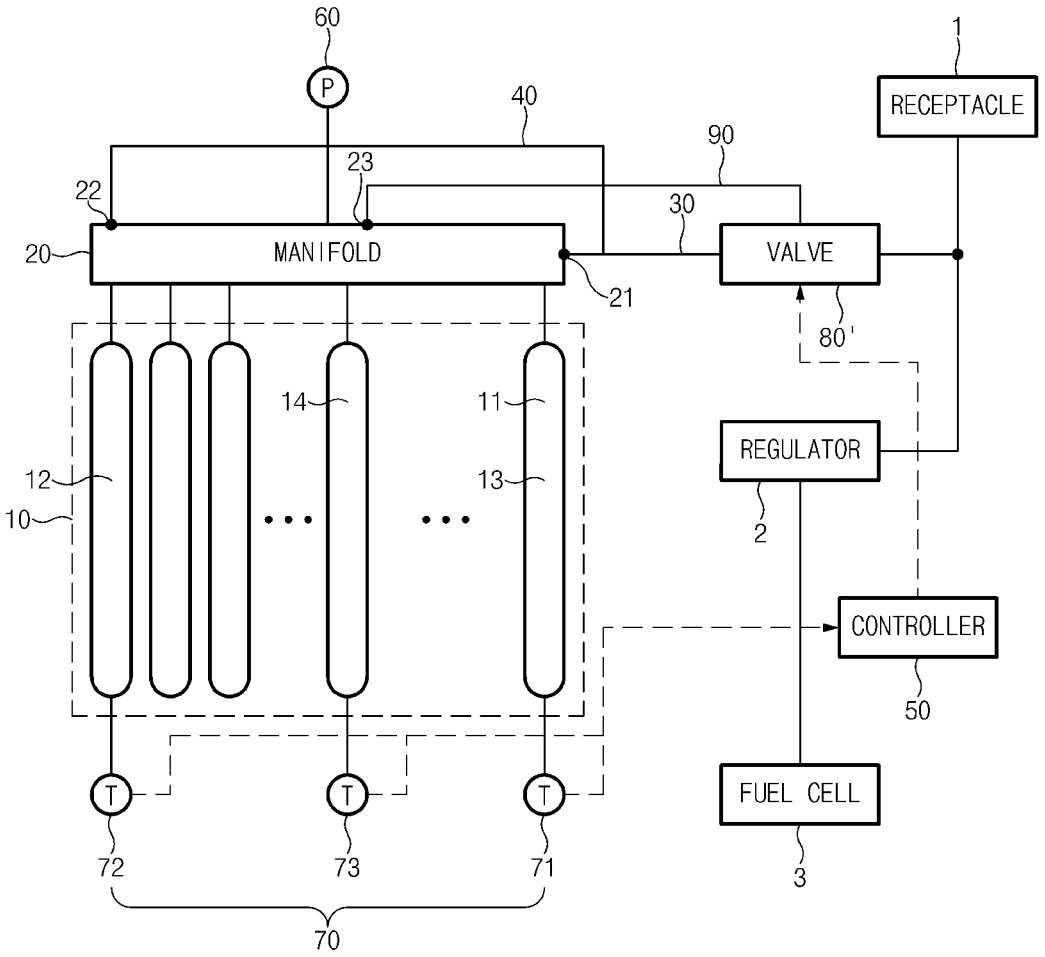
FIG. 8 is a view illustrating a tank filling system according to a third embodiment of the present disclosure.

Hereinafter, with reference to FIG. 8, a tank filling system according to a third exemplary embodiment of the present disclosure will be described in detail. FIG. 8 is a view illustrating a tank filling system according to the third exemplary embodiment of the present disclosure. The tank filling system according to the third exemplary embodiment of the present disclosure is different from the tank filling system of the first exemplary embodiment described above in a presence of a third flow passage. Components that are the same as or equivalent to those in the first exemplary embodiment are assigned with the same or equivalent reference numerals or are omitted, and detailed descriptions thereof are omitted.

As shown in FIG. 8, the tank filling system according to the third exemplary embodiment of the present disclosure may further include a third flow passage 90. The third flow passage 90 may be connected to a third inlet 23 formed between the first inlet 21 and the second inlet 22 of the manifold 20 to supply the fluid into the manifold 20. The controller 50 may be configured to determine the opening and the closing of the first flow passage 30, the second flow passage 40, and the third flow passage 90. For example, the controller 50 may be configured to open the first flow passage 30 and the second flow passage 40 and close the third flow passage 90 before a reference time point, and close the first flow passage 30 and the second flow passage 40 and open the third flow passage 90 after the reference time point. In this connection, a valve 80' may be disposed at a branch point of the first flow passage and the third flow passage.

The controller 50 may be configured to determine whether to convert opened/closed states of the first flow passage 30, the second flow passage 40, and the third flow passage 90 based on information regarding the first temperature, the second temperature, and a third temperature. The third temperature may be a temperature inside a third tank 14 obtained by a third temperature sensor 73 connected to the third tank 14. The third tank 14 may be a tank located close to the third inlet 23.

In the case of the tank filling system according to the third exemplary embodiment of the present disclosure, since the third flow passage 90 is further present, more active filling amount balancing may be performed. In this connection, the number of flow passages that may be added is not limited to one, and the additional flow passage may be expanded to a fourth flow passage, a fifth flow passage, and the like as needed.

Fourth Exemplary Embodiment

Figure 9:
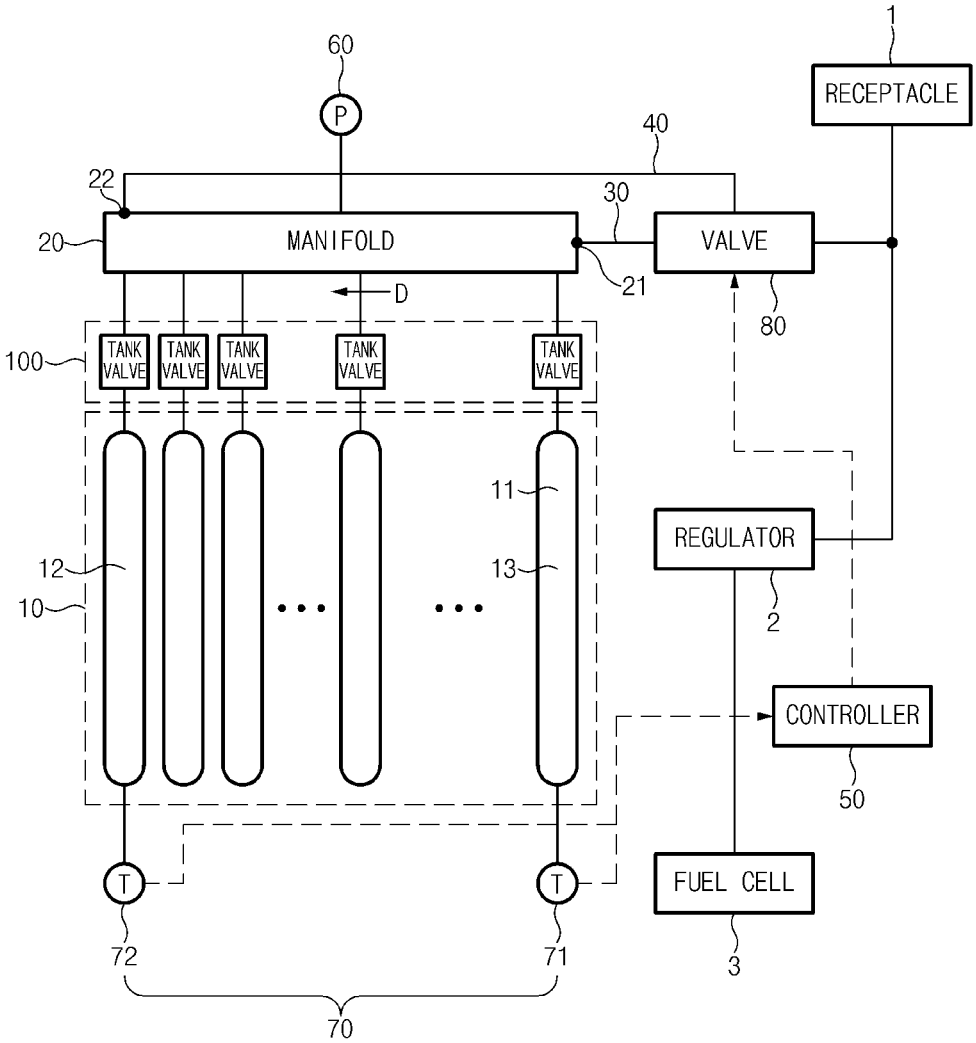
FIG. 9 is a view illustrating a tank filling system according to a fourth exemplary embodiment of the present disclosure.

Hereinafter, with reference to FIG. 9, a tank filling system according to a fourth exemplary embodiment of the present disclosure will be described in detail. FIG. 9 is a view illustrating a tank filling system according to the fourth exemplary embodiment of the present disclosure. The tank filling system according to the fourth exemplary embodiment of the present disclosure differs from the tank filling system of the first exemplary embodiment described above in a presence of a plurality of tank valves 100. Components that are the same as or equivalent to those in the first exemplary embodiment are assigned with the same or equivalent reference numerals or are omitted, and detailed descriptions thereof are omitted.

As shown in FIG. 9, the tank filling system according to the fourth exemplary embodiment of the present disclosure may further include the plurality of tank valves 100. Each of the plurality of tank valves 100 may be disposed at each connection point between each of the plurality of tanks 10 and the manifold 20 to determine whether to communicate each of the plurality of tanks 10 with the manifold 20.

The controller 50 may be configured to operate each of the plurality of tank valves 100 to eliminate the deviation in the filling amount that may occur in the tanks. For example, when the filling amount of the first tank 11 is greater than the filling amount of the second tank 12 by a reference value or more, the controller 50 may be configured to lock a tank valve connected to the first tank 11 and open a tank valve connected to the second tank 12.

Fifth Exemplary Embodiment

Figure 10:
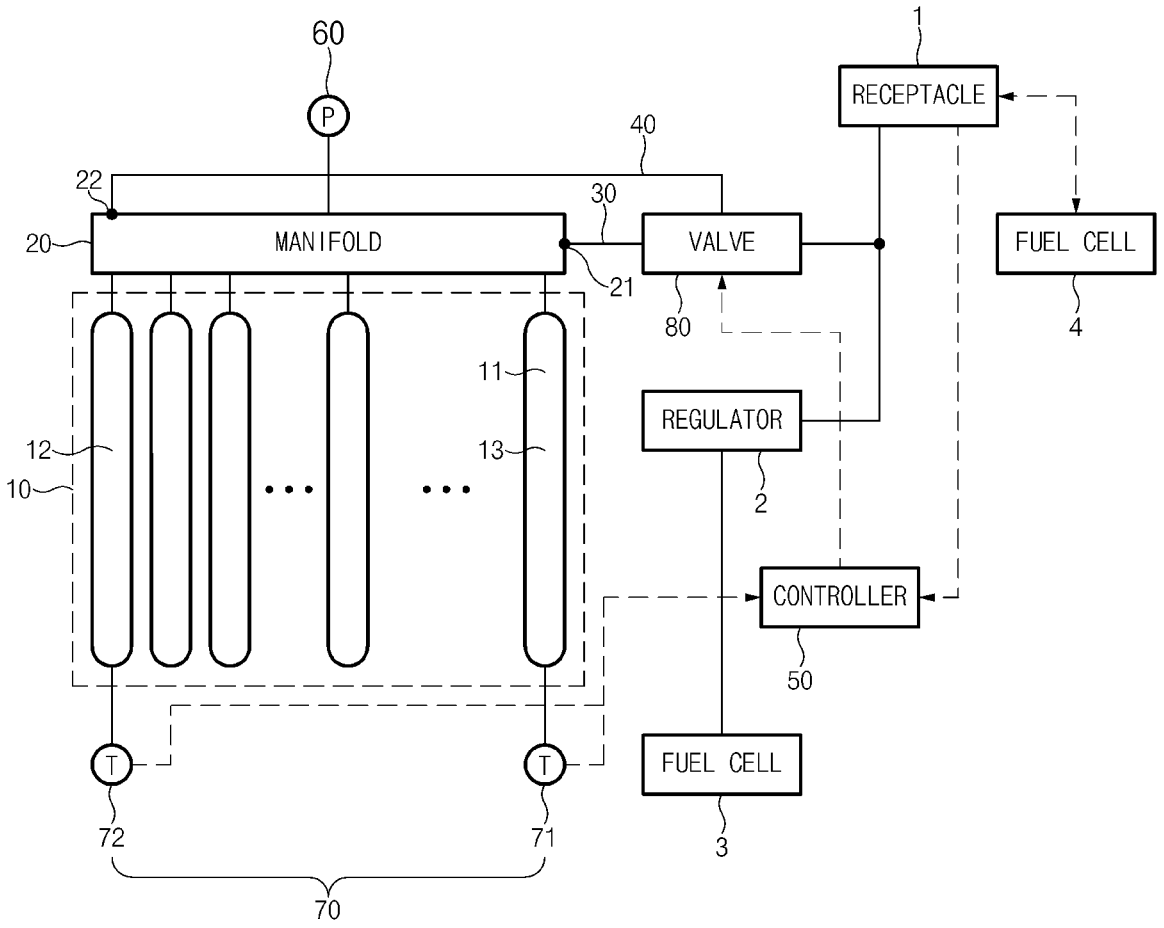
FIG. 10 is a view illustrating a tank filling system according to a fifth exemplary embodiment of the present disclosure.

Hereinafter, with reference to FIG. 10, a tank filling system according to a fifth exemplary embodiment of the present disclosure will be described in detail. FIG. 10 is a view illustrating a tank filling system according to the fifth exemplary embodiment of the present disclosure. The tank filling system according to the fifth exemplary embodiment of the present disclosure differs from the tank filling system of the first exemplary embodiment described above in receiving the target filling amount from an external filling nozzle 4. Components that are the same as or equivalent to those in the first embodiment are assigned with the same or equivalent reference numerals or are omitted, and detailed descriptions thereof are omitted.

The controller 50 of the tank filling system according to the fifth exemplary embodiment of the present disclosure may be configured to receive the target filling amount from the receptacle 1. In this connection, the receptacle 1 may be configured to receive the target filling amount from the external filling nozzle 4. The receptacle 1 may include an IR emitter capable of transmitting and receiving. Since the tank filling system according to the fifth exemplary embodiment of the present disclosure may receive the target filling amount from the external filling nozzle 4, it may become possible to fill the plurality of tanks 10 by a desired filling amount, not a maximum filling amount of the tank.

The description above is merely illustrative of the technical idea of the present disclosure, and various modifications and changes may be made by those skilled in the art without departing from the essential characteristics of the present disclosure. Therefore, the exemplary embodiments disclosed in the present disclosure are not intended to limit the technical idea of the present disclosure but to illustrate the present disclosure, and the scope of the technical idea of the present disclosure is not limited by the embodiments. The scope of the present disclosure should be construed as being covered by the scope of the appended claims, and all technical ideas falling within the scope of the claims should be construed as being included in the scope of the present disclosure.

According to the present disclosure, because the flow passage for injecting the fluid into the manifold may be converted, the deviation between the filling amounts of the plurality of tanks may be balanced.

Hereinabove, although the present disclosure has been described with reference to exemplary embodiments and the accompanying drawings, the present disclosure is not limited thereto, but may be variously modified and altered by those skilled in the art to which the present disclosure pertains without departing from the spirit and scope of the present disclosure claimed in the following claims.

What is claimed is:

1. A system for filling a tank for a fluid storage tank constructed to store fluid to be supplied to a fuel cell stack of a fuel cell vehicle, comprising:

a plurality of tanks to be filled with predetermined fluid;

a manifold coupled to each of the plurality of tanks in a communication manner;

a first flow passage connected to a first inlet of the manifold to supply the fluid to be filled into the plurality of tanks from a receptacle to the manifold;

a second flow passage connected to a second inlet of the manifold spaced apart from the first inlet of the manifold by a predetermined distance to supply the fluid to be filled into the plurality of tanks from the receptacle to the manifold;

a controller configured to adjust opening and closing of the first flow passage and the second flow passage;

wherein one distal end of the first flow passage is connected to the receptacle and another distal end of the first flow passage is connected to the first inlet of the manifold; and wherein one distal end of the second flow passage is connected to the first flow passage and another distal end of the second flow passage is connected to the second inlet of the manifold.

2. The system of claim 1, wherein the controller is configured to adjust the opening and the closing of the first flow passage and the second flow passage based on filling amounts of at least some of the plurality of tanks.

3. The system of claim 1, wherein the controller is configured to:

obtain filling amounts of at least some of the plurality of tanks; and close a flow passage connected to a first of the first inlet and the second inlet close to a maximum filling tank and open a flow passage connected to a second of the first inlet and the second inlet far from the maximum filling tank when a tank having a maximum filling amount among the tanks whose filling amounts are obtained is referred to as the maximum filling tank.

4. The system of claim 1, wherein the controller is configured to:

obtain filling amounts of at least some of the plurality of tanks; and open a flow passage connected to a first of the first inlet and the second inlet close to a minimum filling tank and close a flow passage connected to a second of the first inlet and the second inlet far from the minimum filling tank when a tank having a minimum filling amount among the tanks whose filling amounts are obtained is referred to as the minimum filling tank.

5. The system of claim 1, wherein the controller is configured to:

open the first flow passage and close the second flow passage to initiate supply of the fluid through the first inlet;

obtain a filling amount of a first inlet-closest-tank closest to the first inlet among the plurality of tanks; and close the first flow passage and open the second flow passage to initiate supply of the fluid through the second inlet in response to determining that the filling amount of the first inlet-closest-tank reaches a reference filling amount.

6. The system of claim 5, wherein the controller is configured to determine the reference filling amount based on a difference between the filling amount of the first inlet-closest-tank when the supply of the fluid through the first inlet is initiated, and a target filling amount of the first inlet-closest-tank.

7. The system of claim 1, wherein the plurality of tanks are arranged in a predetermined reference direction, wherein the first inlet is disposed close to a first tank disposed first along the reference direction among the plurality of tanks, wherein the second inlet is disposed close to a second tank disposed last along the reference direction among the plurality of tanks.

8. The system of claim 1, further comprising:

a valve for determining the opening and the closing of the first flow passage and the second flow passage, wherein the controller is configured to operate the valve.

9. The system of claim 8, wherein the second flow passage is connected to the first flow passage, wherein the valve is disposed at a connection point between the first flow passage and the second flow passage to transfer the fluid supplied to the valve to at least one of the first flow passage or the second flow passage.

10. The system of claim 5, wherein the controller is configured to calculate the filling amount of the first inlet-closest-tank based on a pressure inside the first inlet-closest-tank.

11. The system of claim 1, wherein the controller is configured to:

determine whether to divert opened/closed states of the first flow passage and the second flow passage based on comparison between information on a first filling amount that is a filling amount of a first tank disposed first along a predetermined reference direction among the plurality of tanks and information on a second filling amount that is a filling amount of a second tank disposed last along the reference direction among the plurality of tanks, wherein the first inlet is disposed close to the first tank, wherein the second inlet is disposed close to the second tank.

12. The system of claim 11, wherein the controller is configured to open the first flow passage in the closed state and close the second flow passage in the opened state in response to determining that the second filling amount becomes equal to or greater than the first filling amount by supply of the fluid through the second flow passage.

13. The system of claim 11, wherein the controller is configured to:

calculate the first filling amount based on a temperature of the first tank; and calculate the second filling amount based on a temperature of the second tank.

14. A system for filling a tank, comprising:

a tank formed in a tubular shape to be filled with predetermined fluid;

a first flow passage connected to a first entrance of the tank to supply the fluid into the tank from a receptacle;

a second flow passage connected to a second entrance of the tank spaced apart from the first entrance of the tank by a predetermined distance to supply the fluid into the tank from the receptacle; and a controller configured to adjust opening and closing of the first flow passage and the second flow passage based on filling amounts of at least some of a plurality of regions when dividing the tank into the plurality of regions;

wherein one distal end of the first flow passage is connected to the receptacle and another distal end of the first flow passage is connected to the first inlet of the tank; and wherein one distal end of the second flow passage is connected to the first flow passage and another distal end of the second flow passage is connected to the second inlet of the tank.

15. A method for filling a tank for a hydrogen storage tank constructed to store hydrogen to be supplied to a fuel cell stack of a fuel cell vehicle, comprising:

in response to determining that a condition for diverting a flow passage for supplying the hydrogen from a receptacle to a manifold from a first flow passage to a second flow passage based on a filling amount of a first tank is a diversion condition:

injecting, by a controller, the hydrogen into the plurality of tanks through the first flow passage;

diverting, by the controller, the flow passage for supplying the hydrogen to the manifold from the first flow passage to the second flow passage; and closing, by the controller, all flow passages in response to determining that at least one of the plurality of tanks is filled by a target filling amount;

wherein the first flow passage is disposed close to a first tank;

wherein the second flow passage is connected to the manifold to be spaced apart from the first tank, and wherein the first tank is disposed first along a reference direction among a plurality of tanks coupled to the manifold to be arranged in the predetermined reference direction;

wherein one distal end of the first flow passage is connected to the receptacle and another distal end of the first flow passage is connected to the first inlet of the manifold; and wherein one distal end of the second flow passage is connected to the first flow passage and another distal end of the second flow passage is connected to the second inlet of the manifold.

16. The method of claim 15, further comprising:

in response to determining that a condition of re-diverting the flow passage for supplying the hydrogen to the manifold from the second flow passage to the first flow passage is a re-diversion condition, re-diverting, by the controller, the flow passage for supplying the hydrogen to the manifold from the second flow passage to the first flow passage in response to determining that the re-diversion condition has been achieved before closing all the flow passages.

17. The method of claim 15, wherein the second flow passage is a flow passage close to a second tank disposed last along the reference direction among the plurality of tanks.

* * * * *